US011705074B2

(12) United States Patent
Bae et al.

(10) Patent No.: US 11,705,074 B2
(45) Date of Patent: Jul. 18, 2023

(54) DISPLAY DEVICE AND METHOD FOR DRIVING THE SAME

(71) Applicant: Samsung Display Co., Ltd., Yongin-Si (KR)

(72) Inventors: Woomi Bae, Daegu (KR); Hae-Kwan Seo, Hwaseong-si (KR); Youngha Sohn, Seongnam-si (KR); Hyojin Lee, Seongnam-si (KR); Jaekeun Lim, Suwon-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/539,555

(22) Filed: Dec. 1, 2021

(65) Prior Publication Data

US 2022/0238076 A1 Jul. 28, 2022

(30) Foreign Application Priority Data

Jan. 26, 2021 (KR) ..... 10-2021-0011064

(51) Int. Cl.
*G09G 3/3291* (2016.01)
*G09G 3/3233* (2016.01)
*G09G 3/3266* (2016.01)

(52) U.S. Cl.
CPC ..... *G09G 3/3291* (2013.01); *G09G 3/3233* (2013.01); *G09G 3/3266* (2013.01); *G09G 2320/0276* (2013.01); *G09G 2320/0285* (2013.01); *G09G 2360/16* (2013.01)

(58) Field of Classification Search
CPC .. G09G 3/3291; G09G 3/3233; G09G 3/3266; G09G 2320/0276; G09G 2320/0285; G09G 2360/16
See application file for complete search history.

(56) References Cited

U.S. PATENT DOCUMENTS 9,633,608 B2 4/2017 Shin
2021/0035514 A1* 2/2021 Cho ..... G09G 3/2007

FOREIGN PATENT DOCUMENTS

JP 2008310266 A 12/2008
KR 1020150069850 A 6/2015

* cited by examiner

*Primary Examiner* — Kenneth B Lee, Jr.
(74) *Attorney, Agent, or Firm* — Cantor Colburn LLP

(57) ABSTRACT

A display device includes a display panel that includes a first display area and a second display area, a data driving circuit which drives a plurality of data lines, a scan driving circuit which drives a plurality of scan lines, and a driving controller which controls the data driving circuit and the scan driving circuit such that the first display area is driven at a first driving frequency, and the second display area is driven at a second driving frequency lower than the first driving frequency during a multi-frequency mode, where the driving controller receives an image signal and provides to the data driving circuit an image data signal obtained by compensating for a gamma level of the image signal corresponding to the second display area during the multi-frequency mode.

20 Claims, 15 Drawing Sheets

DISPLAY DEVICE AND METHOD FOR DRIVING THE SAME

This application claims priority to Korean Patent Application No. 10-2021-0011064, filed on Jan. 26, 2021, and all the benefits accruing therefrom under 35 U.S.C. § 119, the content of which in its entirety is herein incorporated by reference.

BACKGROUND

1. Field

Embodiments of the invention herein relate to a display device.

2. Description of the Related Art

Among display devices, an organic light-emitting display device displays an image using an organic light emitting diode that generates light by recombination of electrons and holes. The organic light emitting diode display has an advantage of having a fast response speed and being driven with low power consumption.

The organic light emitting display device includes pixels connected to data lines and scan lines. The pixels generally include an organic light emitting diode and a circuit part for controlling an amount of current flowing through the organic light emitting diode. The circuit part controls the amount of current flowing from a first driving voltage to a second driving voltage through an organic light emitting diode in response to a data signal. In this case, light having a predetermined luminance is generated in response to the amount of current flowing through the organic light emitting diode.

In recent years, as a use of mobile devices increases, efforts to reduce power consumption of the display devices continue.

SUMMARY

Embodiments of the invention provide a display device and a driving method capable of reducing power consumption and preventing display quality degradation.

An embodiment of the invention provides a display device including a display panel including a first display area and a second display area, each of the first display area and the second display area including a plurality of pixels, and a pixel of the plurality of pixels being connected to a corresponding data line of a plurality of data lines and corresponding scan lines of a plurality of scan lines, a data driving circuit which drives the plurality of data lines, a scan driving circuit which drives the plurality of scan lines, and a driving controller which controls the data driving circuit and the scan driving circuit such that the second display area is driven at a second driving frequency lower than the first driving frequency during a multi-frequency mode, where the driving controller receives an image signal and provides to the data driving circuit an image data signal obtained by compensating for a gamma level of the image signal corresponding to the second display area during the multi-frequency mode.

In an embodiment, the driving controller may include a frequency mode determination part which determines an operation mode based on the image signal and a control signal and output a mode signal, and a signal generation part which receives the image signal and the control signal and output the image data signal, a data control signal, and a scan control signal corresponding to the mode signal, where the data control signal may be provided to the data driving circuit, where the scan control signal may be provided to the scan driving circuit.

In an embodiment, the signal generation part may include a lookup table which stores a compensation value, and a compensator which outputs the image data signal obtained by compensating the image signal with the compensation value based on the mode signal and the image signal.

In an embodiment, the mode signal may include information on the first driving frequency of the first display area and the second driving frequency of the second display area.

In an embodiment, the compensator may receive a compensation value corresponding to a difference value between the first driving frequency of the first display area and the second driving frequency of the second display area from the lookup table in response to the mode signal.

In an embodiment, the compensator may receive a compensation value corresponding to the image signal from the lookup table.

In an embodiment, the compensator may output the image data signal by adding the compensation value and the image signal from the lookup table.

In an embodiment, the driving controller may control the data driving circuit and the scan driving circuit such that the first display area and the second display area may be each driven at a normal frequency while the operation mode is a normal mode.

In an embodiment, the first driving frequency may be higher than or equal to the normal frequency, and the second driving frequency may be lower than the normal frequency.

In an embodiment of the invention, a display device includes a display panel including a first display area and a second display area, each of the first display area and the second display area including a plurality of pixels, and a pixel of the plurality of pixels being connected to a corresponding data line of a plurality of data lines and corresponding scan lines of a plurality of scan lines, a data driving circuit which drives the plurality of data lines, a scan driving circuit which drives the plurality of scan lines, and a driving controller which controls the data driving circuit and the scan driving circuit such that the first display area is driven at a first driving frequency, and the second display area is driven at a second driving frequency lower than the first driving frequency during a multi-frequency mode, where the driving controller receives an image signal and provides to the data driving circuit an image data signal obtained by compensating for the image signal to the data driving circuit as a compensation value corresponding to a difference value between the first driving frequency of the first display area and the second driving frequency of the second display area during the multi-frequency mode.

In an embodiment, the driving controller may include a frequency mode determination part which determines an operation mode based on the image signal and a control signal and output a mode signal, and a signal generation part which receives the image signal and the control signal, and output the image data signal, a data control signal, and a scan control signal corresponding to a difference value between the first driving frequency of the first display area and the second driving frequency of the second display area in response to the mode signal, where the data control signal may be provided to the data driving circuit, where the scan control signal may be provided to the scan driving circuit.

In an embodiment, the signal generation part may include a lookup table which stores a compensation value, and a compensator which outputs the image data signal obtained by compensating the image signal with the compensation value based on the mode signal and the image signal.

In an embodiment, the driving controller may control the data driving circuit and the scan driving circuit such that the first display area and the second display area may be each driven at a normal frequency while the operation mode is a normal mode.

In an embodiment, the first driving frequency may be higher than or equal to the normal frequency, and the second driving frequency may be lower than the normal frequency.

In an embodiment of the invention, a driving method of a display device includes dividing a display panel into a first display area and a second display area during a multi-frequency mode, driving the first display area at a first driving frequency, and driving the second display area at a second driving frequency, calculating a difference value between the first driving frequency of the first display area and the second driving frequency of the second display area, and when the difference value is greater than or equal to a reference value, outputting an image data signal obtained by compensating for the image signal of the second display area.

In an embodiment, the outputting the image data signal obtained by compensating for the image signal of the second display area may include outputting the image data signal by adding the image signal and a compensation value corresponding to a difference value between the first driving frequency of the first display area and the second driving frequency of the second display area.

In an embodiment, the outputting the image data signal obtained by compensating for the image signal of the second display area may include outputting the image data signal by adding a compensation value corresponding to the image signal and the image signal.

In an embodiment, the method may further include outputting the image signal of the second display area as the image data signal when the difference value is less than the reference value.

In an embodiment, the method may further include driving the first display area and the second display area at a normal frequency during a normal mode.

In an embodiment, the first driving frequency may be higher than or equal to the normal frequency, and the second driving frequency may be lower than the normal frequency.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain principles of the invention. In the drawings.

DETAILED DESCRIPTION

Figure 1:
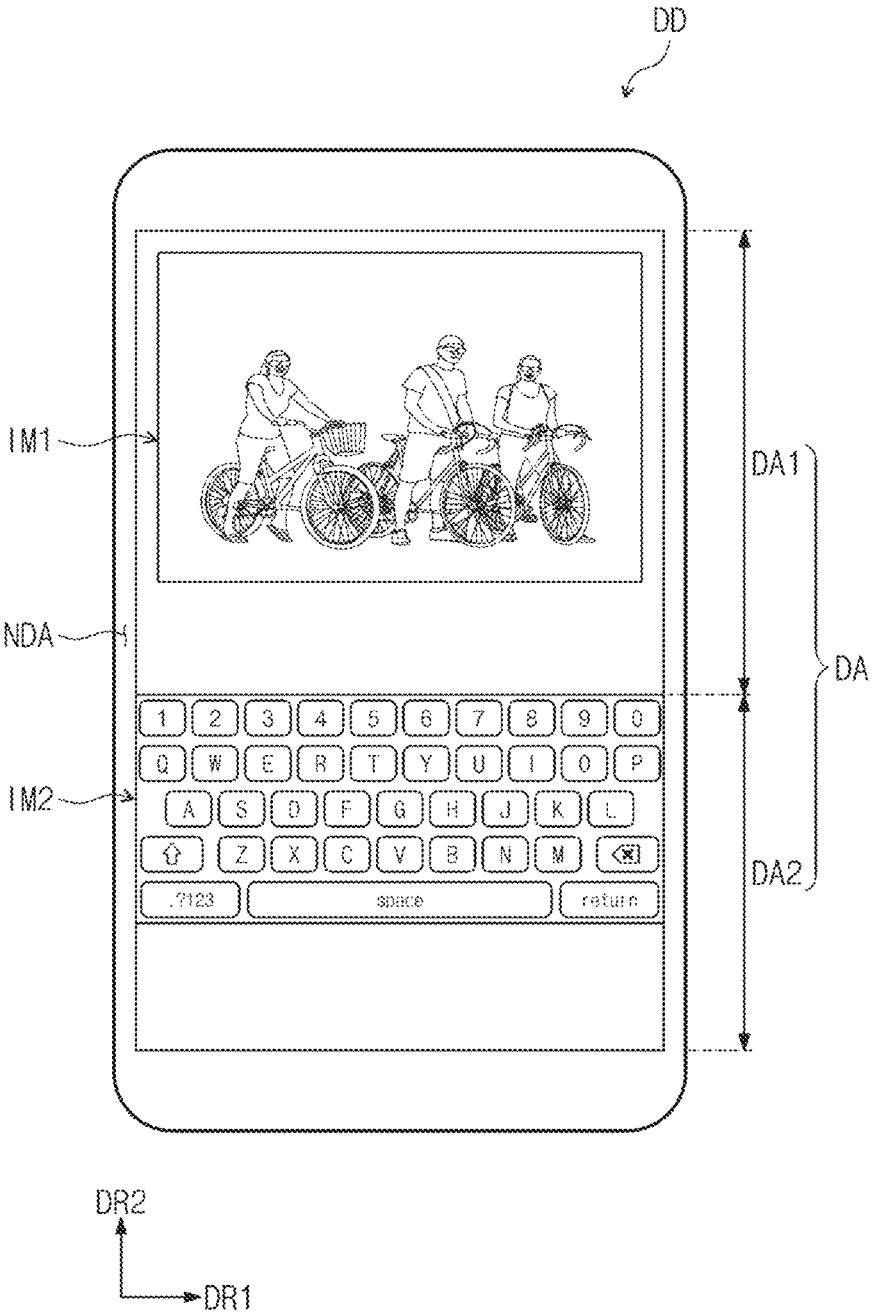
FIG. 1 is a perspective view of an embodiment of a display device according to the invention.

In this specification, when an element (or region, layer, part, etc.) is also referred to as being "on", "connected to", or "coupled to" another element, it means that it may be directly placed on/connected to/coupled to other components, or a third component may be arranged between them.

Like reference numerals refer to like elements. Additionally, in the drawings, the thicknesses, proportions, and dimensions of components are exaggerated for effective description. "And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the invention. The terms of a singular form may include plural forms unless otherwise specified.

In addition, terms such as "below", "the lower side", "on", and "the upper side" are used to describe a relationship of configurations shown in the drawing. The terms are described as a relative concept based on a direction shown in the drawing.

In various embodiments of the invention, the term "include," "comprise," "including," or "comprising," specifies a property, a region, a fixed number, a step, a process, an element and/or a component but does not exclude other properties, regions, fixed numbers, steps, processes, elements and/or components.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. In addition, terms defined in a commonly used dictionary should be interpreted as having a meaning consistent with the meaning in the context of the related technology, and unless interpreted in an ideal or overly formal sense, the terms are explicitly defined herein. A term such as "part" may mean a circuit or a processor, for example.

Hereinafter, embodiments of the invention will be described with reference to the drawings.

FIG. 1 is a perspective view of an embodiment of a display device according to the invention.

Referring to FIG. 1, a portable terminal is illustrated as an embodiment of a display device DD according to the invention. The portable terminal may include a tablet personal computer ("PC"), a smart phone, a personal digital assistant ("PDA"), a portable multimedia player ("PMP"), a game console, and a wristwatch type electronic device. However, the invention is not limited thereto. Embodiments of the invention may be used in large electronic equipment such as televisions or external billboards, as well as small and medium-sized electronic equipment such as personal computers, notebook computers, kiosks, car navigation units, and cameras. These are only presented by way of example, and may be employed in other electronic devices without departing from the concept of the invention.

As shown in FIG. 1, the display surface on which the first image IM1 and the second image IM2 are displayed is parallel to a plane defined by the first direction DR1 and the second direction DR2. The display device DD includes a plurality of areas divided on the display surface. The display surface includes a display area DA in which the first and second images IM1 and IM2 are displayed, and a non-display area NDA adjacent to the display area DA. The non-display area NDA may be also referred to as a bezel area. In an embodiment, the display area DA may have a quadrangular (e.g., rectangular) shape, for example. The non-display area NDA surrounds the display area DA. Further, although not shown in the drawing, for example, the display device DD may have a partially curved shape. As a result, one area of the display area DA may have a curved shape.

The display area DA of the display device DD includes a first display area DA1 and a second display area DA2. In a predetermined application program, the first image IM1 may be displayed in the first display area DA1, and the second image IM2 may be displayed in the second display area DA2. In an embodiment, the first image IM1 may be a moving picture, and the second image IM2 may be a still image or text information which is not changed frequently, for example.

The display device DD in an embodiment may drive the first display area DA1 in which a moving image is displayed at a normal frequency or a frequency higher than the normal frequency, and drive the second display area DA2 in which the still image is displayed at a frequency lower than the normal frequency. The display device DD may reduce power consumption by lowering the driving frequency of the second display area DA2.

The sizes of each of the first and second display areas DA1 and DA2 may be preset sizes, and may be changed by an application program. In an embodiment, when the first display area DA1 displays a still image and the second display area DA2 displays a moving image, the first display area DA1 may be driven at a frequency lower than the normal frequency, and the second display area DA2 may be driven at a normal frequency or a higher frequency than the normal frequency. In addition, the display area DA may be divided into three or more display areas, and the driving frequency of each of the display areas may be determined according to the type of image (still image or moving image) displayed on each of the display area.

Figure 2A:
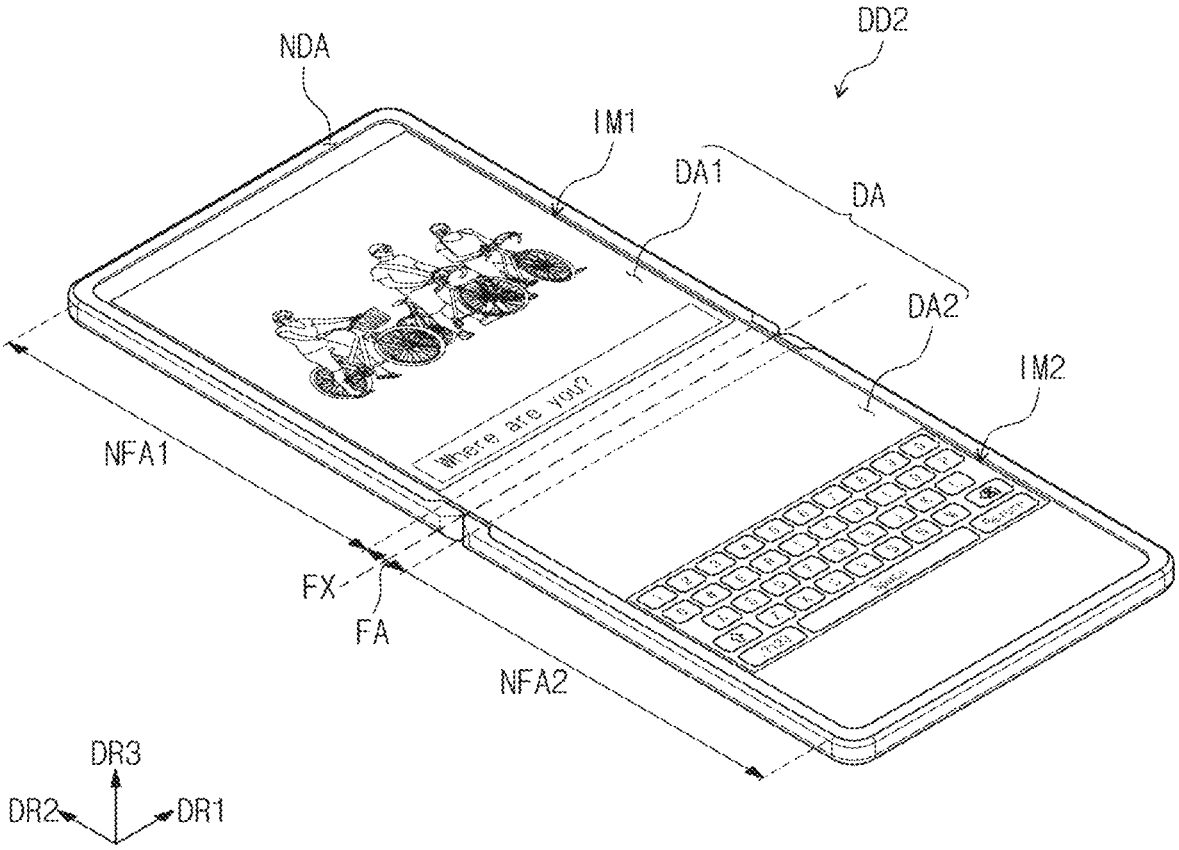
FIGS. 2A and 2B are perspective views of an embodiment of display device according to the invention.
Figure 2B:
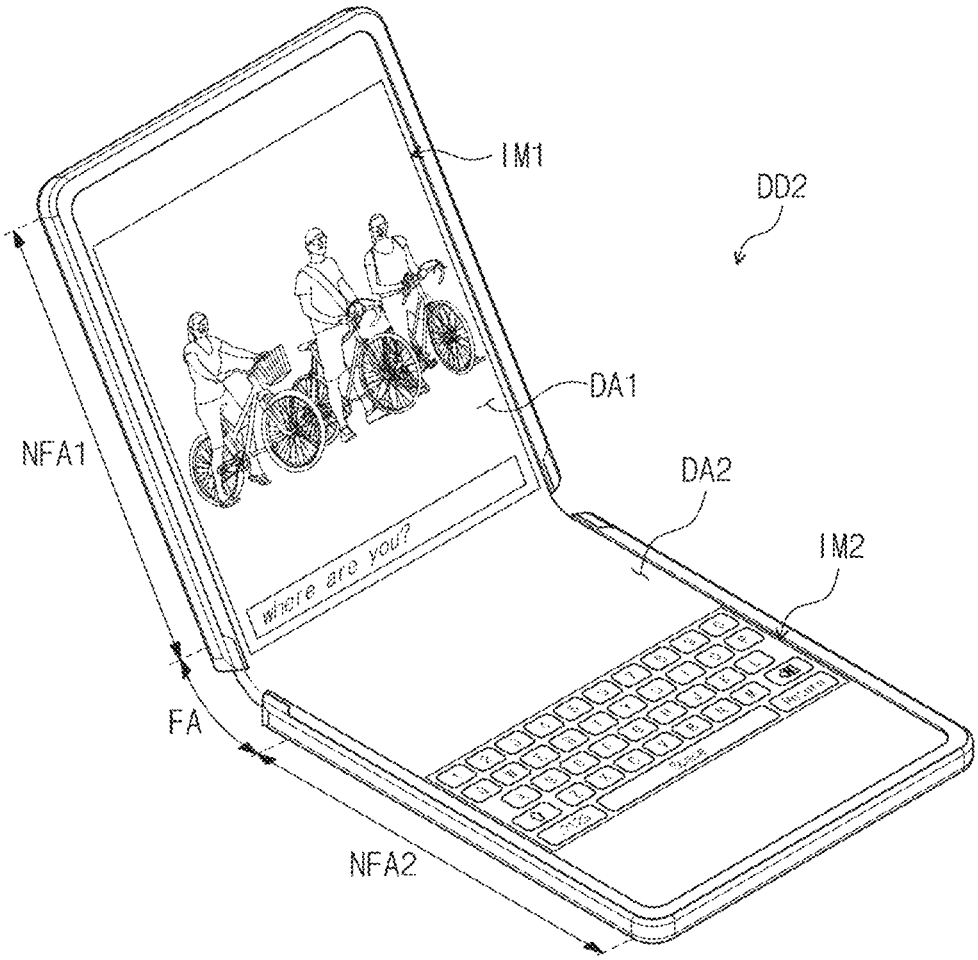

FIGS. 2A and 2B are perspective views of an embodiment of a display device DD2 according to the invention. FIG. 2A illustrates a state in which the display device DD2 is unfolded, and FIG. 2B illustrates a state in which the display device DD2 is folded.

As shown in FIGS. 2A and 2B, the display device DD2 includes a display area DA and a non-display area NDA. The display device DD2 may display an image through the display area DA. When the display device DD2 is unfolded, the display area DA may include a plane defined by the first direction DR1 and the second direction DR2. The thickness direction of the display device DD2 may be parallel to the third direction DR3 intersecting a plane defined by the first direction DR1 and the second direction DR2. Accordingly, the front (or upper) and rear (or lower) surfaces of the members constituting the display device DD2 may be defined with respect to the third direction DR3. The non-display area NDA may be also referred to as a bezel area. In an embodiment, the display area DA may have a quadrangular (e.g., rectangular) shape. The non-display area NDA surrounds the display area DA, for example.

The display area DA may include a first non-folding area NFA1, a folding area FA, and a second non-folding area NFA2. The folding area FA may be bent with reference to the folding axis FX extending along the first direction DR1.

When the display device DD2 is folded, the first non-folding area NFA1 and the second non-folding area NFA2 may face each other. Accordingly, in the fully folded state, the display area DA may not be exposed to the outside, and this state may be referred to as in-folding state. However, this is exemplary, and the configuration of the display device DD2 is not limited thereto.

In an embodiment of the invention, when the display device DD2 is folded, the first non-folding area NFA1 and the second non-folding area NFA2 may be opposed to each other. Accordingly, in the folded state, the first non-folding area NFA1 and the second non-folding area NFA2 may be exposed to the outside, and this state may be referred to as out-folding state.

The display device DD2 may perform only one operation of in-folding or out-folding. In an alternative embodiment, the display device DD2 may perform both an in-folding operation and an out-folding operation. In this case, the same area of the display device DD2, for example, the folding area FA, may be in-folded and out-folded. In an alternative embodiment, some areas of the display device DD2 may be in-folded and other areas may be out-folded.

In FIGS. 2A and 2B, for example, one folding area and two non-folding areas are illustrated, but the number of folding areas and non-folding areas is not limited thereto. In an embodiment, the display device DD2 may include more than two non-folding areas and a plurality of folding areas disposed between adjacent non-folding areas, for example.

FIGS. 2A and 2B show that the folding axis FX is parallel to the short axis of the display device DD2 but the invention is not limited thereto. In an embodiment, the folding axis FX may extend along a long axis of the display device DD2, for example, a direction parallel to the second direction DR2, for example.

FIGS. 2A and 2B show that the first non-folding area NFA1, the folding area FA, and the second non-folding area NFA2 are sequentially arranged along the second direction DR2 but the invention is not limited thereto. In an embodiment, the first non-folding area NFA1, the folding area FA, and the second non-folding area NFA2 may be sequentially arranged along the first direction DR1, for example.

A plurality of display areas DA1 and DA2 may be defined in the display area DA of the display device DD2. In FIG. 2A, two display areas DA1 and DA2 are illustrated by way of example, but the number of the plurality of display areas DA1 and DA2 is not limited thereto.

The plurality of display areas DA1 and DA2 may include a first display area DA1 and a second display area DA2. In an embodiment, the first display area DA1 may be an area in which the first image IM1 is displayed, and the second display area DA2 may be an area in which the second image IM2 is displayed, for example, but the invention is limited thereto. In an embodiment, the first image IM1 may be a moving image, and the second image IM2 may be a still image or an image with a long change period (text information, or the like), for example.

The display device DD2 in an embodiment may operate differently according to an operation mode. The operation mode may include a normal mode and a multi-frequency mode. The display device DD2 may drive both the first display area DA1 and the second display area DA2 at the normal mode during the normal frequency mode. In the display device DD2 in an embodiment, during the multi-frequency mode, the first display area DA1 in which the first image IM1 is displayed is driven at a first driving frequency, and the second display area DA2 in which the second image IM2 is displayed may be driven at a second driving frequency lower than the normal frequency. In an embodiment, the first driving frequency may be equal to or higher than the normal frequency.

The sizes of each of the first and second display areas DA1 and DA2 may be predetermined sizes, and may be changed by an application program. In an embodiment, the first display area DA1 may correspond to the first non-folding area NFA1, and the second display area DA2 may correspond to the second non-folding area NFA2. In addition, the first portion of the folding area FA may correspond to the first display area DA1, and the second portion of the folding area FA may correspond to the second display area DA2.

In an embodiment, all of the folding area FA may correspond to only one of the first display area DA1 and the second display area DA2.

In an embodiment, the first display area DA1 may correspond to a first portion of the first non-folding area NFA1, and the second display area DA2 may correspond to a second portion of the first non-folding area NFA1, the folding area FA, and the second non-folding area NFA2. That is, the area of the second display area DA2 may be larger than the area of the first display area DA1.

In an embodiment, the first display area DA1 corresponds to a first portion of the first non-folding area NFA1, the folding area FA, and the second non-folding area NFA2, and the second display area DA2 may correspond to a second portion of the second non-folding area NFA2. That is, the area of the first display area DA1 may be larger than the area of the second display area DA2.

As shown in FIG. 2B, in a folded state of the display device DD2, the first display area DA1 may correspond to the first non-folding area NFA1, and the second display area DA2 may correspond to the folding area FA and the second non-folding area NFA2.

FIGS. 2A and 2B illustrate a display device DD2 having one folding area as an embodiment of a display device, the invention is not limited thereto. In an embodiment, the invention may be applied to a display device having two or more folding areas, a rollable display device, a slider display device, or the like, for example.

In the following description, the display device DD illustrated in FIG. 1 is described as an example, but may be equally applied to the display device DD2 illustrated in FIGS. 2A and 2B.

Figure 3A:
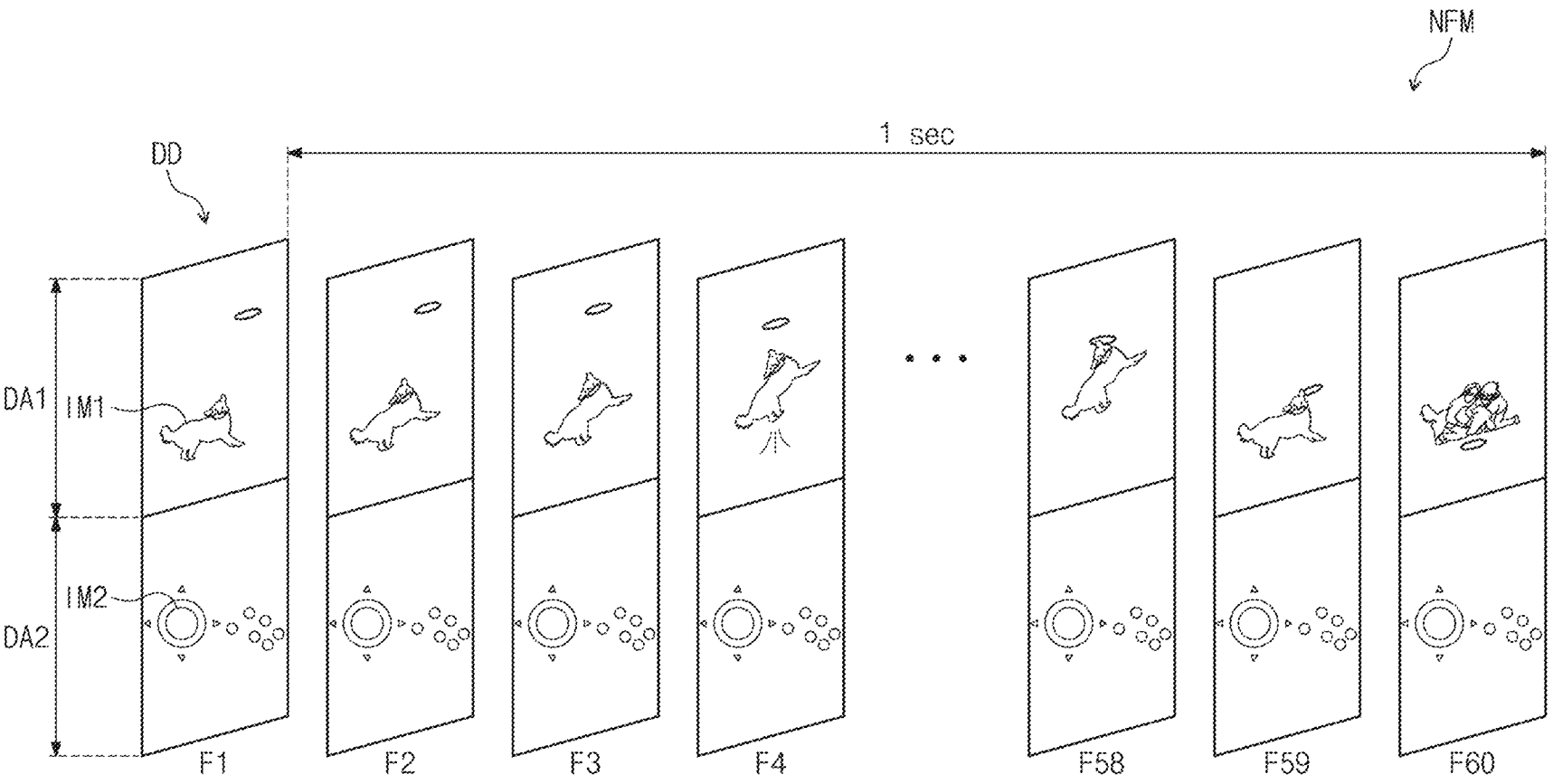
FIG. 3A is a diagram illustrating an operation of a display device in a normal mode.
Figure 3B:
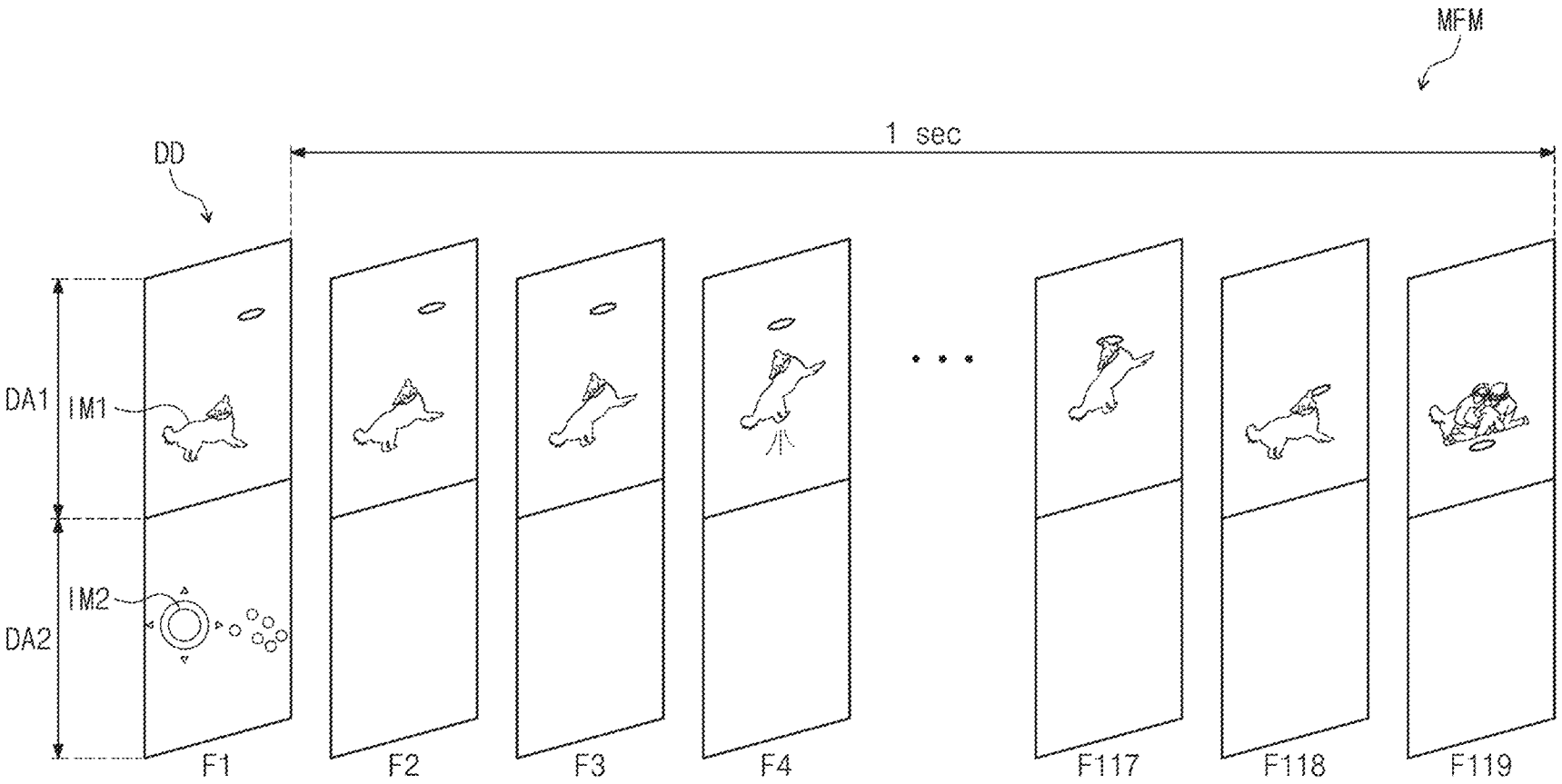
FIG. 3B is a diagram illustrating an operation of a display device in a multi-frequency mode.

FIG. 3A is a diagram illustrating an operation of a display device in a normal mode. FIG. 3B is a diagram illustrating an operation of a display device in a multi-frequency mode.

Referring to FIG. 3A, the first image IM1 displayed on the first display area DA1 is a moving image, and the second image IM2 displayed on the second display area DA2 may be a still image or an image having a long change period (e.g., a keypad for game manipulation). The first image IM1 displayed in the first display area DA1 and the second image IM2 displayed in the second display area DA2 shown in FIG. 1 are only examples, and various images may be displayed on the display device DD.

In the normal mode NFM, driving frequencies of the first display area DA1 and the second display area DA2 of the display device DD are normal frequencies. In an embodiment, the normal frequency may be about 60 hertz (Hz), for example. In the normal mode NFM, images of the first frame F1 to the 60th frame F60 are displayed for 1 second in the first display area DA1 and the second display area DA2 of the display device DD.

Referring to FIG. 3B, in the multi-frequency mode MFM, the display device DD may set the driving frequency of the first display area DA1 in which the first image IM1, that is, a moving image, is displayed as the first driving frequency, and may set the driving frequency of the second display area DA2 in which the second image IM2, that is, a still image, is displayed as a second driving frequency lower than the first driving frequency. In an embodiment, the first driving frequency may be about 119 Hz and the second driving frequency may be about 1 Hz. The first driving frequency and the second driving frequency may be variously changed. In an embodiment, the first driving frequency may be one of about 110 Hz, about 90 Hz and about 80 Hz, and the second driving frequency may be one of about 10 Hz, about 30 Hz, and about 40 Hz lower than the normal frequency, for example.

In the multi-frequency mode MFM, when the first driving frequency is about 119 Hz and the second driving frequency is about 1 Hz, the first image IM1 is displayed in each of the first frame F1 to the 119th frame F119 in the first display area DA1 of the display device DD for 1 second. The second image IM2 may be displayed only in the first frame F1 in the second display area DA2, and the image may not be displayed in the remaining frames F2 to F119. The operation of the display device DD in the multi-frequency mode MFM will be described in detail later.

Figure 4:
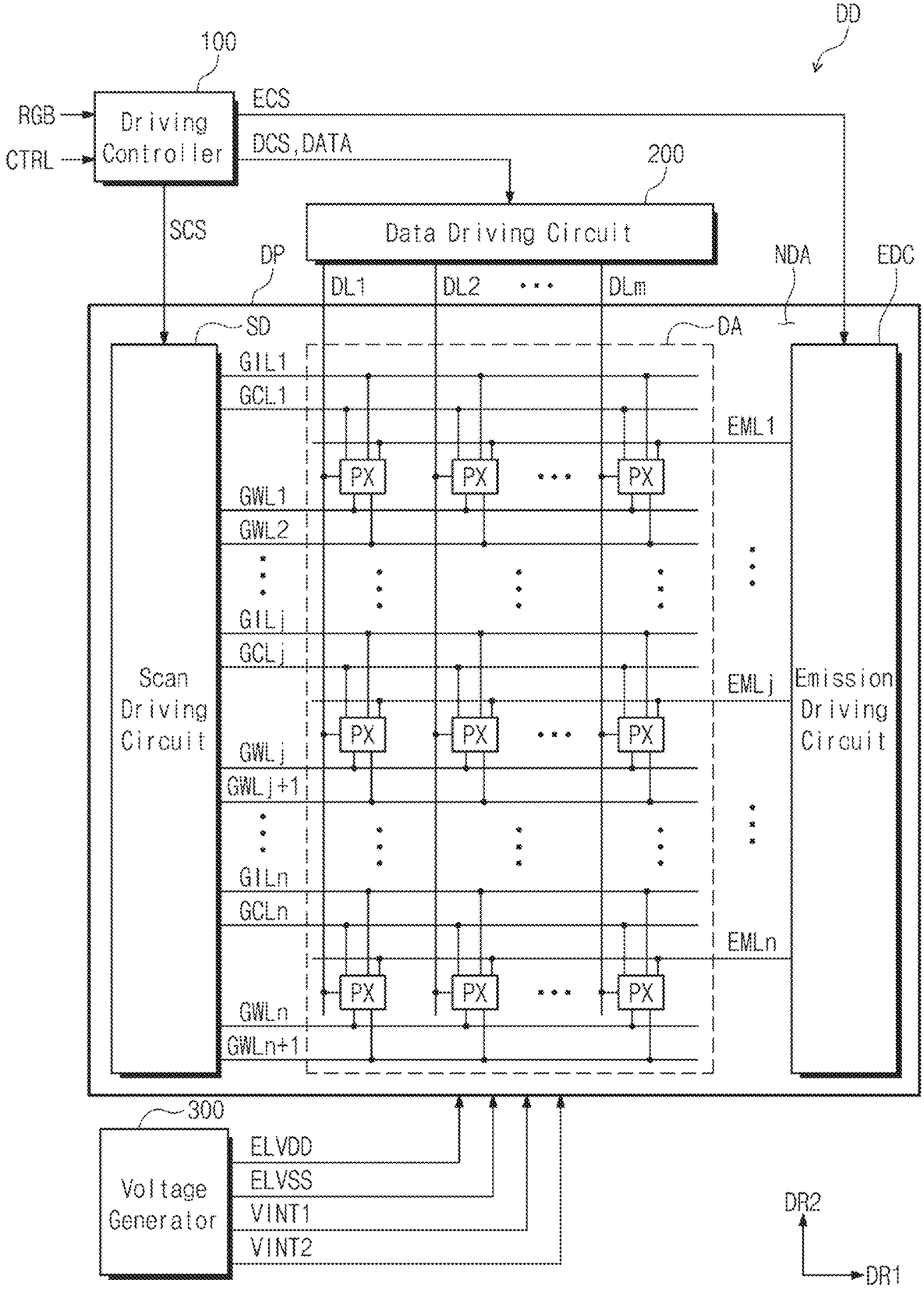
FIG. 4 is a block diagram of an embodiment of a display device according to the invention.

FIG. 4 is a block diagram of an embodiment of a display device according to the invention.

Referring to FIG. 4, a display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting a data format of the image signal RGB to meet the specification of an interface with the data driving circuit 200. The driving controller 100 outputs a scan control signal SCS, a data control signal DCS, and an emission control signal ECS.

During the multi-frequency mode, when the difference between the image signal of the current frame and the image signal of the previous frame to be displayed in the first display area DA1 (refer to FIG. 1) is greater than the reference value, the driving controller 100 in an embodiment of the invention may change an operation mode to a normal mode.

The data driving circuit 200 receives a data control signal DCS and an image data signal DATA from the driving controller 100. The data driving circuit 200 converts the image data signal DATA into data signals, and outputs the data signals to a plurality of data lines DL1 to DLm (m is a natural number greater than 1), which will be described later. The data signals are analog voltages corresponding to the grayscale value of the image data signal DATA.

The voltage generator 300 generates voltages necessary for the operation of the display panel DP. In this embodiment, the voltage generator 300 generates a first driving voltage ELVDD, a second driving voltage ELVSS, a first initialization voltage VINT1, and a second initialization voltage VINT2.

The display panel DP includes scan lines GIL1 to GILn (n is a natural number greater than 1), GCL1 to GCLn, and GWL1 to GWLn+1, emission control lines EML1 to EMLn, data lines DL1 to DLm, and pixels PX. The display panel DP may further include a scan driving circuit SD and an emission driving circuit EDC. In an embodiment, the scan driving circuit SD is arranged on the first side (e.g., left side in FIG. 4) of the display panel DP. The scan lines GIL1 to GILn, GCL1 to GCLn, and GWL1 to GWLn+1 extend from the scan driving circuit SD in the first direction DR1.

The emission driving circuit EDC is arranged on the second side (e.g., right side in FIG. 4) of the display panel DP. The emission control lines EML1 to EMLn extend in a direction opposite to the first direction DR1 from the emission driving circuit EDC.

The scan lines GIL1 to GILn, GCL1 to GCLn, and GWL1 to GWLn+1 and the emission control lines EML1 to EMLn are arranged to be spaced apart from each other in the second direction DR2. The data lines DL1 to DLm extend in a direction opposite to the second direction DR2 from the data driving circuit 200 and are arranged to be spaced apart from each other in the first direction DR1.

In the example shown in FIG. 4, the scan driving circuit SD and the emission driving circuit EDC are arranged facing each other with pixels PX disposed therebetween, but the invention is not limited thereto. In an embodiment, the scan driving circuit SD and the emission driving circuit EDC may be disposed adjacent to each other on one of the first side and the second side of the display panel DP, for example. In an embodiment, the scan driving circuit SD and the emission driving circuit EDC may be configured as one circuit.

A pixel PX of the plurality of pixels PX is electrically connected to corresponding scan lines among the scan lines GIL1 to GILn, GCL1 to GCLn, and GWL1 to GWLn+1, a corresponding emission control line among the emission control lines EML1-EMLn, and a corresponding data line of the data lines DL1-DLm. Each of the plurality of pixels PX may be electrically connected to four scan lines and one emission control line. In an embodiment, as illustrated in FIG. 4, the pixels in the first row may be connected to the scan lines GILL GCL1, GWL1, and GWL2 and the emission control line EML1, for example. Also, the pixels PX in the j-th row (j is a natural number less than n) may be connected to the scan lines GILj, GCLj, GWLj, and GWLj+1 and the emission control line EMLj.

Each of the plurality of pixels PX includes a light emitting diode ED (refer to FIG. 5) and a pixel circuit PXC (refer to FIG. 5) that controls light emission of the light emitting diode ED. The pixel circuit PXC may include at least one transistor and at least one capacitor. The scan driving circuit SD and the emission driving circuit EDC may include transistors formed or provided through the same process as the pixel circuit PXC.

Each of the plurality of pixels PX receives a first driving voltage ELVDD, a second driving voltage ELVSS, a first initialization voltage VINT1, and a second initialization voltage VINT2 from the voltage generator 300.

The scan driving circuit SD receives a scan control signal SCS from the driving controller 100. The scan driving circuit SD may output scan signals to the scan lines GIL1 to GILn, GCL1 to GCLn, and GWL1 to GWLn+1 in response to the scan control signal SCS. The circuit configuration and operation of the scan driving circuit SD will be described in detail later.

The driving controller 100 in an embodiment divides the display panel DP into a first display area DA1 (refer to FIG. 1) and a second display area DA2 (refer to FIG. 1) based on an image signal RGB and may set driving frequencies of the first display area DA1 and the second display area DA2. In an embodiment, the driving controller 100 drives the first display area DA1 and the second display area DA2 at a normal frequency (e.g., about 60 Hz) in the normal mode, for example. The driving controller 100 may drive the first display area DA1 at a first driving frequency (e.g., about 119 Hz) and the second display area DA2 at a second driving frequency (e.g., about 1 Hz) in a multi-frequency mode.

Figure 5:
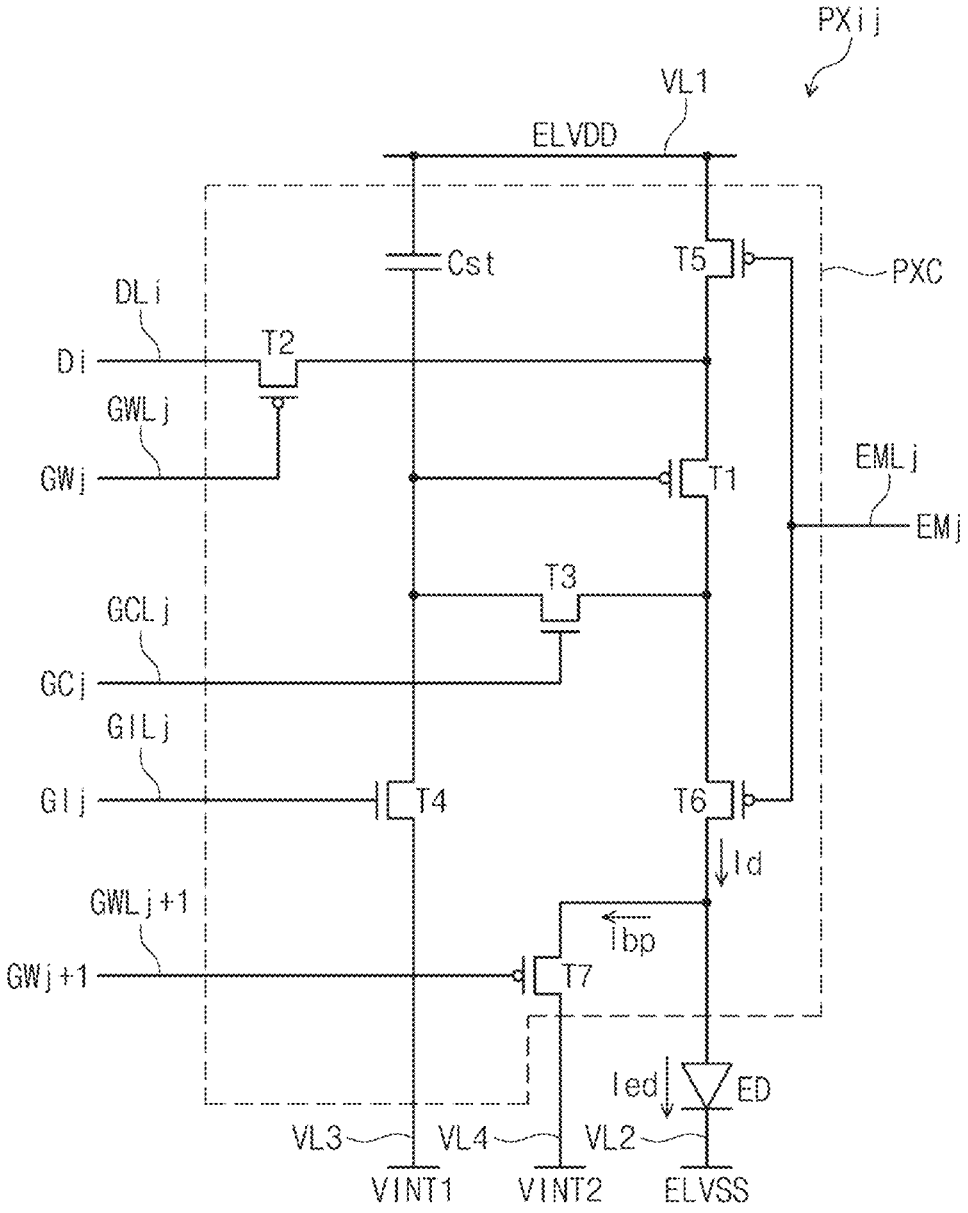
FIG. 5 is an equivalent circuit diagram of an embodiment of a pixel according to the invention.

FIG. 5 is an equivalent circuit diagram of an embodiment of a pixel according to the invention.

FIG. 5 shows an equivalent circuit diagram of a pixel PXij connected to the i-th data line DLi (i is a natural number less than m) among the data lines DL1 to DLm, the j-th scan lines GILj, GCLj, and GWLj and the (j+1)-th scan line GWLj+1 among the scan lines GIL1 to GILn, GCL1 to GCLn, and GWL1 to GWLn+1, and the j-th emission control line EMLj among the emission control lines EML1 to EMLn, which are shown in FIG. 4.

Each of the plurality of pixels PX illustrated in FIG. 4 may have the same circuit configuration as the equivalent circuit diagram of the pixel PXij illustrated in FIG. 5. In this embodiment, in relation to the pixel circuit PXC of the pixel PXij, the third and fourth transistors T3 and T4 of the first to seventh transistors T1 to T7 are N-type transistors having an oxide semiconductor as a semiconductor layer, and each of the first, second, fifth, sixth, and seventh transistors T1, T2, T5, T6, and T7 is a P-type transistor having a low-temperature polycrystalline silicon ("LTPS") semiconductor layer. However, the invention is not limited thereto, and the first to seventh transistors T1 to T7 may be entirely P-type transistors or N-type transistors. In an embodiment, at least one of the first to seventh transistors T1 to T7 may be an N-type transistor and the rest may be a P-type transistor. Further, the circuit configuration of the pixel according to the invention is not limited to FIG. 5. The pixel circuit PXC illustrated in FIG. 5 is only an example, and the configuration of the pixel circuit PXC may be modified and implemented.

Referring to FIG. 5, a pixel PXij of the display device in an embodiment includes first to seventh transistors T1, T2, T3, T4, T5, T6, and T7, a capacitor Cst, and at least one light emitting diode ED. In this embodiment, an example in which one pixel PXij includes one light emitting diode ED will be described.

The scan lines GILj, GCLj, GWLj, and GWLj+1 may transmit scan signals GIj, GCj, GWj, and GWj+1, respectively, and the emission control line EMLj may transmit the emission signal EMj. The data line DLi transmits the data signal Di. The data signal Di may have a voltage level corresponding to the image signal RGB inputted to the display device DD (refer to FIG. 4). The first to fourth driving voltage lines VL1, VL2, VL3, and VL4 may respectively transmit a first driving voltage ELVDD, a second driving voltage ELVSS, a first initialization voltage VINT1, and a second initialization voltage VINT2.

The first transistor T1 includes a first electrode connected to the first driving voltage line VL1 through a fifth transistor T5, a second electrode electrically connected to the anode of the light emitting diode ED through the sixth transistor T6, and a gate electrode connected to one end of the capacitor Cst. The first transistor T1 may receive the data signal Di transmitted from the data line DLi according to the switching operation of the second transistor T2 and supply the driving current Id to the light emitting diode ED.

The second transistor T2 includes a first electrode connected to the data line DLi, a second electrode connected to the first electrode of the first transistor T1, and a gate electrode connected to the scan line GWLj. The second transistor T2 may be turned on according to the scan signal GWj received through the scan line GWLj to transmit the data signal Di transmitted from the data line DLi to the first electrode of the first transistor T1.

The third transistor T3 includes a first electrode connected to the gate electrode of the first transistor T1, a second electrode connected to the second electrode of the first transistor T1, and a gate electrode connected to the scan line GCLj. The third transistor T3 may be turned on according to the scan signal GCj received through the scan line GCLj and may diode-connect the first transistor T1 by connecting the gate electrode and the second electrode of the first transistor T1 to each other.

The fourth transistor T4 includes a first electrode connected to the gate electrode of the first transistor T1, a second electrode connected to the third driving voltage line VL3 to which the first initialization voltage VINT' is transmitted, and a gate electrode connected to the scan line GILj. The fourth transistor T4 is turned on according to the scan signal GIj received through the scan line GILj, and transmits the first initialization voltage VINT1 to the gate electrode of the first transistor T1 so that an initialization operation of initializing the voltage of the gate electrode of the first transistor T1 may be performed.

The fifth transistor T5 includes a first electrode connected to the first driving voltage line VL1, a second electrode connected to the first electrode of the first transistor T1, and a gate electrode connected to the emission control line EMLj.

The sixth transistor T6 includes a first electrode connected to the second electrode of the first transistor T1, a second electrode connected to the anode of the light emitting diode ED, and a gate electrode connected to the emission control line EMLj.

The fifth transistor T5 and the sixth transistor T6 are simultaneously turned on according to the emission signal EMj received through the emission control line EMLj and through this, the first driving voltage ELVDD may be compensated through the diode-connected first transistor T1 and transmitted to the light emitting diode ED.

The seventh transistor T7 includes a first electrode connected to the second electrode of the sixth transistor T6, a second electrode connected to the fourth driving voltage line VL4, and a gate electrode connected to the scan line GWLj+1. The seventh transistor T7 is turned on according to the scan signal GWj+1 transmitted through the scan line GWLj+1, and bypasses the current of the anode of the light emitting diode ED to the fourth driving voltage line VL4.

As described above, one end of the capacitor Cst is connected to the gate electrode of the first transistor T1 and the other end is connected to the first driving voltage line VL1. The cathode of the light emitting diode ED may be connected to the second driving voltage line VL2 transmitting the second driving voltage ELVSS. The structure of the pixel PXij in the embodiment is not limited to the structure illustrated in FIG. 5, and the number of transistors and the number of capacitors included in one pixel PXij, and a connection relationship may be variously modified.

Figure 6:
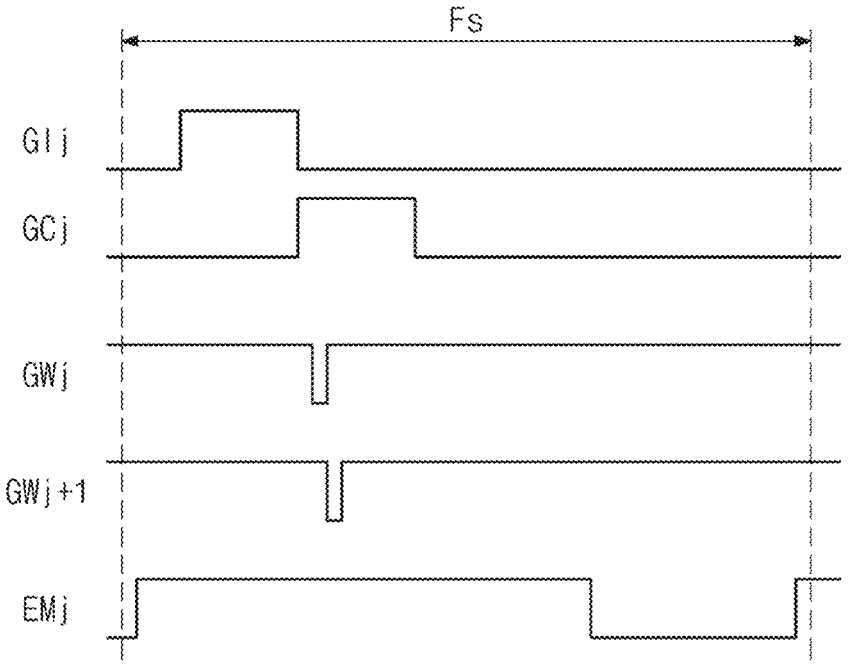
FIG. 6 is a timing diagram for explaining an operation of the pixel shown in FIG. 5.

FIG. 6 is a timing diagram for explaining an operation of the pixel shown in FIG. 5. An operation of the display device in an embodiment will be described with reference to FIGS. 5 and 6.

Referring to FIGS. 5 and 6, a high level scan signal GIj is provided through a scan line GILj during an initialization period within one frame Fs. The fourth transistor T4 is turned on in response to the high-level scan signal GIj, and the first initialization voltage VINT1 is transmitted to the gate electrode of the first transistor T1 through the fourth transistor T4, so that the first transistor T1 is initialized.

Next, during the data programming and compensation period, when the high level scan signal GCj is supplied through the scan line GCLj, the third transistor T3 is turned on. The first transistor T1 is diode-connected by the turned-on third transistor T3 and is biased in the forward direction. Also, the second transistor T2 is turned on by the low-level scan signal GWj. Then, the compensation voltage reduced by the threshold voltage of the first transistor T1 from the data signal Di supplied from the data line DLi is applied to the gate electrode of the first transistor T1. That is, the gate voltage applied to the gate electrode of the first transistor T1 may be the compensation voltage.

A first driving voltage ELVDD and a compensation voltage are applied to both ends of the capacitor Cst, and a charge corresponding to a voltage difference between both ends may be stored in the capacitor Cst.

The seventh transistor T7 is turned on by receiving the low-level scan signal GWj+1 through the scan line GWLj+1. A portion of the driving current Id may escape through the seventh transistor T7 as a bypass current Ibp by the seventh transistor T7.

Even when the minimum current of the first transistor T1 displaying a black image flows as the driving current, when the light emitting diode ED emits light, a black image is not properly displayed. Accordingly, the seventh transistor T7 in the pixel PXij in an embodiment of the invention may distribute a portion of the minimum current of the first transistor T1 as the bypass current Ibp to a current path other than the current path toward the light emitting diode. Here, the minimum current of the first transistor T1 means a current under a condition in which the first transistor T1 is turned off because the gate-source voltage of the first transistor T1 is less than the threshold voltage. In this way, the minimum driving current (e.g., a current of about 10 picoampere (pA) or less) under the condition of turning off the first transistor T1 is transmitted to the light emitting diode ED, and is expressed as an image of black luminance. It may be said that when the minimum driving current to display a black image flows, the effect of bypass transmission of the bypass current Ibp is large, but when a large driving current that displays an image such as a normal or white image flows, there is little effect of the bypass current Ibp. Therefore, when the driving current for displaying a black image flows, the emission current led of the light emitting diode ED, which is reduced by the amount of the bypass current Ibp escaped from the driving current Id through the seventh transistor T7, has the minimum amount of current at a level that may reliably represent a black image. Accordingly, an accurate black luminance image may be implemented using the seventh transistor T7 to improve a contrast ratio. In this embodiment, the bypass signal is a low-level scan signal GWj+1, but is not limited thereto.

Next, during the emission period, the emission signal EMj supplied from the emission control line EMLj is changed from the high level to the low level. During the emission period, the fifth transistor T5 and the sixth transistor T6 are turned on by the low-level emission signal EMj. Then, a driving current Id according to the voltage difference between the gate voltage of the gate electrode of the first transistor T1 and the first driving voltage ELVDD is generated, and the driving current Id is supplied to the light emitting diode ED through the sixth transistor T6, so that the current led flows through the light emitting diode ED.

Figure 7:
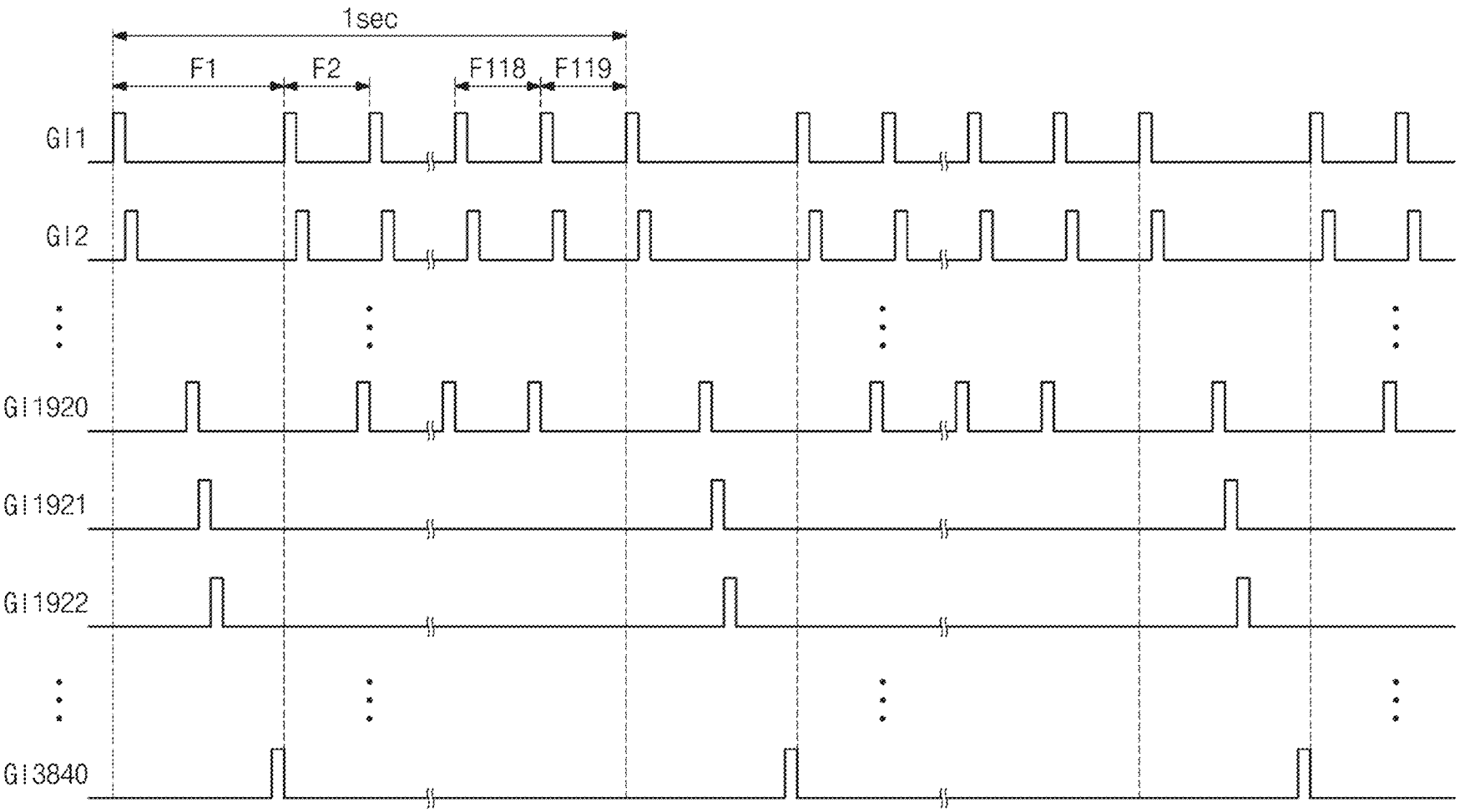
FIG. 7 shows scan signals in a multi-frequency mode.

FIG. 7 shows scan signals GI1 to GI3840 in a multi-frequency mode.

Referring to FIG. 7, in the multi-frequency mode, the frequency of scan signals GI1 to GI1920 is about 119 Hz, and the frequency of scan signals GI1921 to GI 3840 is about 1 Hz.

In an embodiment, the scan signals GI1 to GI1920 correspond to the first display area DA1 of the display device DD illustrated in FIG. 1, and the scan signals GI1921 to GI3840 correspond to the second display area DA2, for example.

The scan signals GI1 to GI1920 may be activated at a high level in each of the first frame F1 to the 119th frame F119, and the scan signals GI1921 to GI3840 may be activated at a high level only in the first frame F1.

Accordingly, the first display area DA1 in which the moving image is displayed may be driven by scan signals GI1 to GI1920 of a normal frequency (e.g., about 119 Hz), and the second display area DA2 in which the still image is displayed may be driven with scan signals GI1921 to GI3840 having a low frequency (e.g., about 1 Hz). Since only the second display area DA2 in which the still image is displayed is driven at a low frequency, power consumption may be reduced without deteriorating the display quality of the display device DD (refer to FIG. 1).

FIG. 7 illustrates only the scan signals GI1 to GI3840 as an example, and the scan driving circuit SD (refer to FIG. 4) and the emission driving circuit EDC (refer to FIG. 4) may generate scan signals GC1 to GC3840 and GW1 to GW 3840 similar to the scan signals GI1 to GI3840 and emission signals EM1 to EM3840.

Figure 8A:
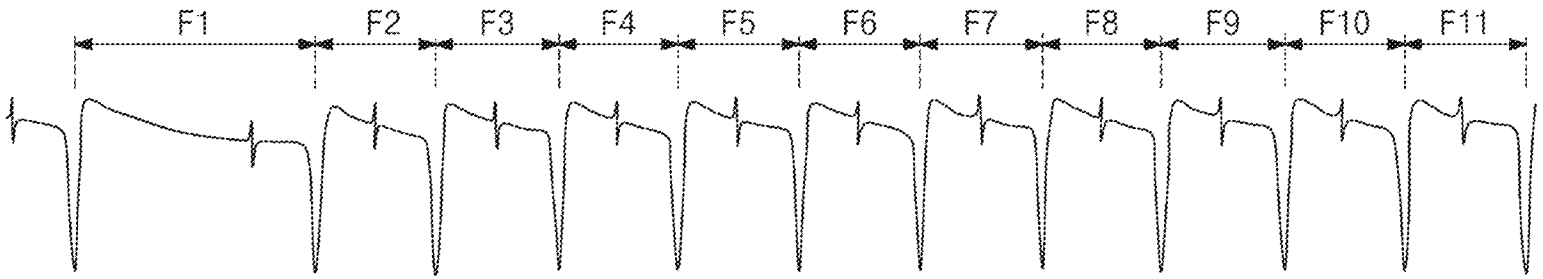
FIGS. 8A and 8B show optical waveforms outputted from light in each of the first display area and the second display area in a multi-frequency mode.
Figure 8B:
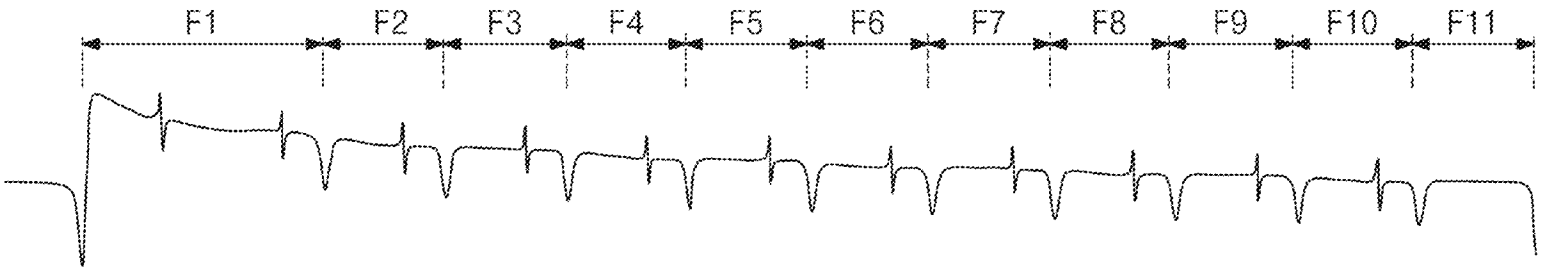

FIGS. 8A and 8B show optical waveforms outputted from light in each of the first display area and the second display area in a multi-frequency mode. The optical waveforms shown in FIGS. 8A and 8B are waveforms of optical signals measured using equipment for measuring gamma levels and/or luminance levels. FIGS. 8A and 8B show only the optical waveforms in frames F1 to F11 among the first frame F1 to the 119th frame F119 illustrated in FIG. 7.

First, referring to FIGS. 7 and 8A, the scan signals GI1 to GI1920 are activated at a high level in each of the frames F1 to F11 during the multi-frequency mode. That is, the first display area DA1 displays an image corresponding to the data signal every frame.

Referring to FIGS. 7 and 8B, during the multi-frequency mode, the scan signals GI1921 to GI3840 are activated at a high level only in the first frame F1, and are maintained at a low level in the remaining frames F2 to F11. That is, the second display area DA2 displays an image corresponding to the data signal only in the first frame F1. Therefore, it may be seen that the optical waveform level of the second display area DA2 gradually decreases as time elapses.

Even when images of the same grayscale are displayed in the first display area DA1 and the second display area DA2, as time passes, the deviation of the optical waveforms of the first display area DA1 and the second display area DA2 increases.

Figure 9:
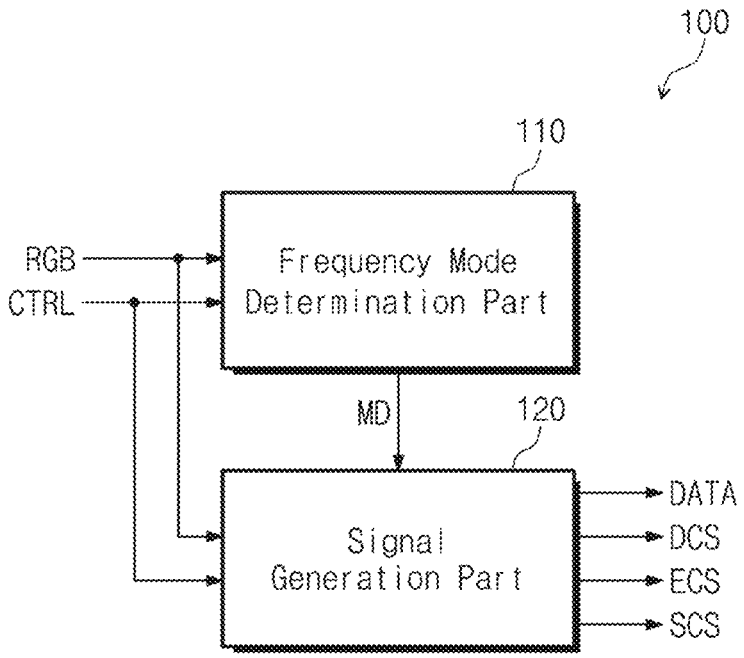
FIG. 9 is a block diagram showing an embodiment of the configuration of a driving controller according to the invention.

FIG. 9 is a block diagram showing an embodiment of the configuration of a driving controller according to the invention.

Referring to FIGS. 4 and 9, the driving controller 100 includes a frequency mode determination part 110 and a signal generation part 120. The frequency mode determination part 110 determines a frequency mode based on an image signal RGB and a control signal CTRL, and outputs a mode signal MD corresponding to the determined frequency mode. In an embodiment, the frequency mode determination part 110 may determine a frequency mode based on an operation mode signal provided from an external device (e.g., a main processor, a graphic processor, or the like). In an embodiment, when a predetermined application program is being executed, the frequency mode determination part 110 may output a mode signal MD indicating a multi-frequency mode, for example. The mode signal MD includes information on whether the operation mode is a normal mode or a multi-frequency mode, as well as information on a first driving frequency of the first display area DA1 and a second driving frequency of the second display area DA2.

The signal generation part 120 outputs an image data signal DATA, a data control signal DCS, an emission control signal ECS, and a scan control signal SCS in response to the image signal RGB, the control signal CTRL, and the mode signal MD.

When the mode signal MD indicates normal mode, the signal generation part 120 may output an image data signal DATA, a data control signal DCS, an emission control signal ECS, and a scan control signal SCS to drive the first display area DA1 (refer to FIG. 1) and the second display area DA2 (refer to FIG. 1) at a normal frequency, respectively.

When the mode signal MD indicates multi-frequency mode, the signal generation part 120 may output an image data signal DATA, a data control signal DCS, an emission control signal ECS, and a scan control signal SCS to drive the first display area DA1 at a first driving frequency and drive the second display area DA2 at a second driving frequency.

When the mode signal MD indicates multi-frequency mode, the signal generation part 120 may output an image data signal DATA obtained by compensating an image signal to be provided to the second display area DA2 among the image signals RGB with a preset value.

The data driving circuit 200, the scan driving circuit SD, and the emission driving circuit EDC shown in FIG. 4 operate to display an image on the display panel DP in response to an image data signal DATA, a data control signal DCS, an emission control signal ECS, and a scan control signal SCS.

Figure 10:
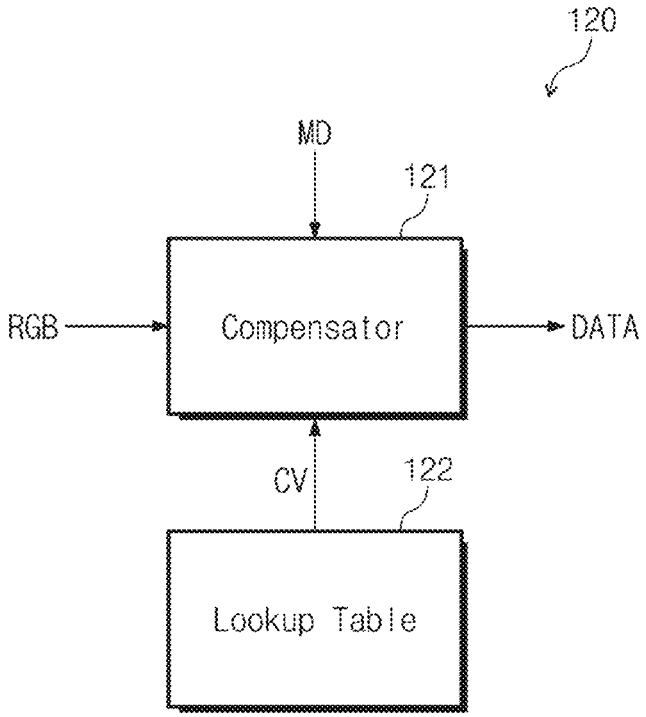
FIG. 10 is a block diagram illustrating a circuit configuration of the signal generation part shown in FIG. 9.

FIG. 10 is a block diagram illustrating an exemplary circuit configuration of the signal generation part 120 shown in FIG. 9.

In FIG. 10, only circuit blocks of the signal generation part 120 related to image compensation are illustrated by way of example. The signal generation part 120 may further include various circuit blocks for outputting an image data signal DATA, a data control signal DCS, an emission control signal ECS, and a scan control signal SCS in response to the image signal RGB, the control signal CTRL, and the mode signal MD.

Referring to FIG. 10, the signal generation part 120 includes a compensator 121 and a lookup table 122. In an embodiment, the lookup table 122 may store a compensation value CV corresponding to a difference between the first driving frequency of the first display area DA1 and the second driving frequency of the second display area DA2. In an embodiment, the lookup table 122 may store a compensation value CV corresponding to a grayscale level of the image signal RGB.

In an embodiment, the compensator 121 may read a compensation value CV corresponding to a difference value between the first driving frequency of the first display area DA1 and the second driving frequency of the second display area DA2 indicated by the mode signal MD from the lookup table 122, and may output the image data signal DATA by adding the compensation value CV to the image signal RGB of the second display area DA2 (refer to FIG. 1).

In an embodiment, when the first driving frequency of the first display area DA1 is about 119 Hz and the second driving frequency of the second display area DA2 is about 1 Hz, the compensation value CV may be a first value. In an embodiment, when the first driving frequency of the first display area DA1 is about 90 Hz and the second driving frequency of the second display area DA2 is about 30 Hz, the compensation value CV may be a second value. As the difference between the first driving frequency of the first display area DA1 and the second driving frequency of the second display area DA2 increases, the deviation of the optical waveforms of the first display area DA1 and the second display area DA2 increases. Therefore, the first value may be greater than the second value.

The compensator 121 outputs an image data signal DATA by adding a compensation value CV to the image signal RGB. Therefore, due to the difference between the first driving frequency of the first display area DA1 and the second driving frequency of the second display area DA2, a gamma level and/or luminance deviation between the first and second display areas DA1 and DA2 may be minimized.

In an embodiment, when the mode signal MD indicates multi-frequency mode, the compensator 121 may read a compensation value CV corresponding to the image signal RGB of the second display area DA2 (refer to FIG. 1) from the lookup table 122, and may output the image data signal DATA by adding the compensation value CV to the image signal RGB.

In an embodiment, the image signal RGB may correspond to any one of grayscales from 0 to 255, for example. The gamma level and/or luminance change of the image signal RGB when the image signal RGB corresponds to 10-level grayscale and the gamma level and/or luminance change of the image signal RGB when the image signal RGB corresponds to 250-level grayscale may be different from each other.

Therefore, the compensator 121 may output the image data signal DATA by adding the compensation value CV corresponding to the image signal RGB to the image signal RGB during the multi-frequency mode.

In an embodiment, the compensator 121 may output the image data signal DATA without a separate compensation operation for the image signal RGB of the first display area DA1.

Figure 11:
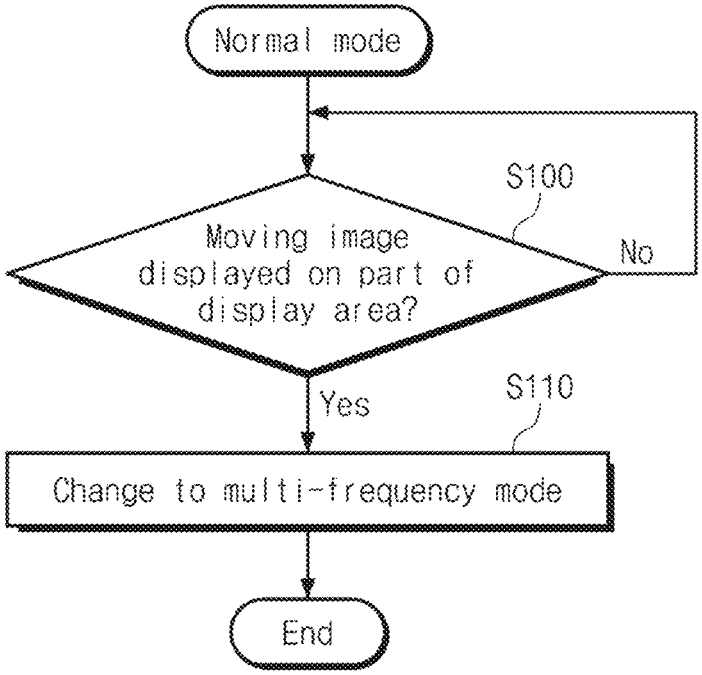
FIG. 11 is a flowchart illustrating an embodiment of an operation of a driving controller according to the invention.

FIG. 11 is a flowchart illustrating an embodiment of an operation of a driving controller according to the invention.

Referring to FIGS. 9 and 11, the frequency mode determination part 110 of the driving controller 100 may initially set the operation mode to a normal mode (e.g., after power-up).

The frequency mode determination part 110 determines a frequency mode in response to an image signal RGB and a control signal CTRL. In an embodiment, a part (e.g., an image signal corresponding to the first display area DA1 (refer to FIG. 1)) of the image signals RGB of one frame is a moving image, and the other part (e.g., an image signal corresponding to the second display area DA2 (refer to FIG. 1)) is a still image (operation S100), the frequency mode determination part 110 changes the operation mode to a multi-frequency mode, and outputs a mode signal MD corresponding to the determined frequency mode (operation S110), for example. The mode signal MD includes information on whether the operation mode is a normal mode or a multi-frequency mode, as well as information on a first driving frequency of the first display area DA1 and a second driving frequency of the second display area DA2.

Figure 12:
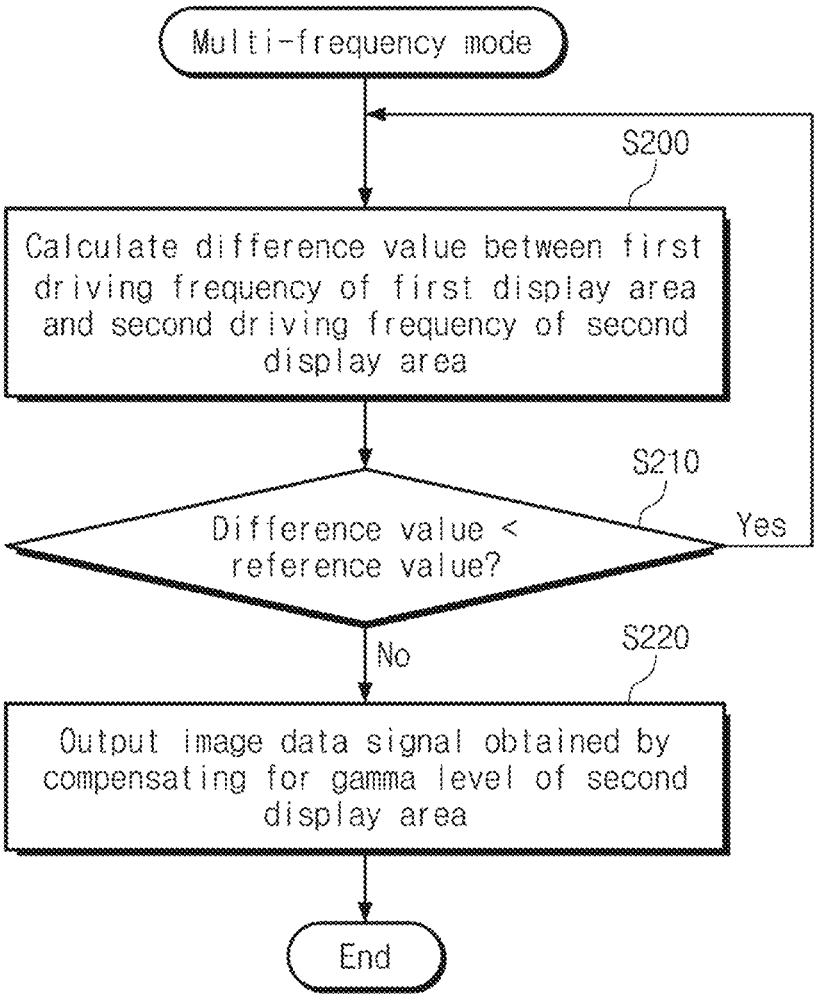
FIG. 12 is a flowchart illustrating an embodiment of an operation of a driving controller in a multi-frequency mode according to the invention.

FIG. 12 is a flowchart illustrating an embodiment of an exemplary operation of a driving controller in a multi-frequency mode according to the invention.

Referring to FIGS. 9, 10, and 12, during the multi-frequency mode, the first display area DA1 may be driven at a first driving frequency, and the second display area DA2 may be driven at a second driving frequency lower than the first driving frequency.

The compensator 121 in the signal generation part 120 of the driving controller 100 calculates a difference value between the first driving frequency of the first display area DA1 (refer to FIG. 1) and the second driving frequency of the second display area DA2 (refer to FIG. 1) based on the mode signal MD (operation S200).

When the difference between the first driving frequency in the first display area DA1 (refer to FIG. 1) and the second driving frequency in the second display area DA2 (refer to FIG. 1) is less than the reference value (operation S210), the compensator 121 may not perform a separate compensation operation.

When the difference between the first driving frequency in the first display area DA1 (refer to FIG. 1) and the second driving frequency in the second display area DA2 (refer to FIG. 1) is greater than or equal to the reference value (operation S210), the compensator 121 outputs an image data signal DATA obtained by compensating for the gamma level of the image signal RGB corresponding to the second display area DA2 (refer to FIG. 1) (operation S220).

Various methods of compensating for the gamma level of the image signal RGB may be implemented. In an embodiment, as shown in FIG. 10, the compensator 121 may output an image data signal DATA obtained by compensating the gamma level of the image signal RGB by the compensation value CV previously stored in the lookup table 122, for example.

In an embodiment, when the difference value between the first driving frequency and the second driving frequency is greater than or equal to the reference value, the compensator 121 adds a compensation value corresponding to the image signal RGB of the second display area DA2 (refer to FIG. 1) to the image signal RGB to output an image data signal DATA.

Figure 13:
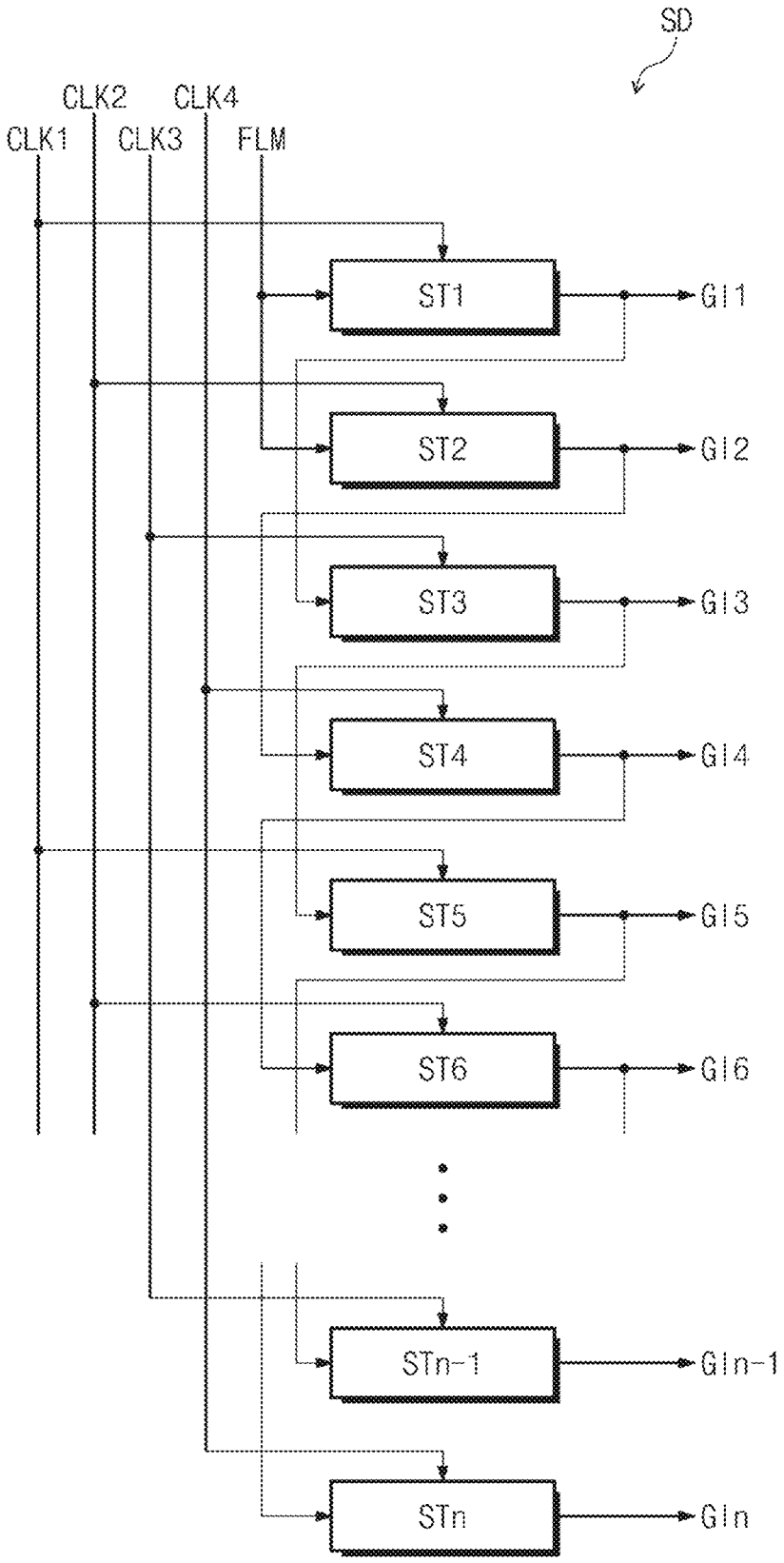
FIG. 13 is a block diagram of an embodiment of a scan driving circuit according to the invention.

FIG. 13 is a block diagram of an embodiment of a scan driving circuit according to the invention.

Referring to FIG. 13, the scan driving circuit SD includes driving stages ST1 to STn.

Each of the driving stages ST1 to STn receives a scan control signal SCS (refer to FIGS. 4 and 9) from the driving controller 100 shown in FIG. 4. The scan control signal SCS includes a start signal FLM, a first clock signal CLK1, a second clock signal CLK2, a third clock signal CLK3, and a fourth clock signal CLK4. The first clock signal CLK1, the second clock signal CLK2, the third clock signal CLK3, and the fourth clock signal CLK4 may be clock signals having the same period and different times of activation to the high level. FIG. 13 shows that each of the driving stages ST1 to STn receives only one corresponding clock signal among the first clock signal CLK1, the second clock signal CLK2, the third clock signal CLK3, and the fourth clock signal CLK4, but the invention is not limited thereto. In an embodiment, each of the driving stages ST1 to STn may receive two or more corresponding clock signals among the first clock signal CLK1, the second clock signal CLK2, the third clock signal CLK3, and the fourth clock signal CLK4.

In an embodiment, the driving stages ST1 to STn respectively output scan signals GI1 to GIn. The scan signals GI1 to GIn respectively outputted from the driving stages ST1 to STn may be provided to the scan lines GIL1 to GILn (refer to FIG. 4) of the display panel DP (refer to FIG. 4), respectively.

Although not shown in the drawing, the driving stages ST1 to STn may further output scan signals GC1 to GCn and scan signals GW1 to GWn+1. In an embodiment, the scan driving circuit SD may further include driving stages for outputting scan signals GC1 to GCn and scan signals GW1 to GWn+1.

The driving stages ST1 to STn may be divided into first group driving stages ST1, ST3, ST5, . . . , STn−1 and second group driving stages ST2, ST4, ST6, . . . , STn.

The first group driving stages ST1, ST3, ST5, . . . , STn−1 output odd-numbered scan signals GI1, GI3, GI5, . . . , GIn−1, and the second group driving stages ST2, ST4, ST6, STn output even-numbered scan signals GI2, GI4, GI6, GIn.

Each of the first group driving stage ST1 and the second group driving stage ST2 may receive a start signal FLM as a carry signal.

Each of the first group driving stages ST1, ST3, ST5, . . . , STn−1 has a dependent connection relationship in which a scan signal outputted from the previous first group driving stage is received as a carry signal. In an embodiment, the first group driving stage ST3 receives the scan signal GI1 outputted from the previous first group driving stage ST1 as a carry signal, and the first group driving stage ST5 receives the scan signal GI3 outputted from the previous first group driving stage ST3 as a carry signal, for example.

Each of the first group driving stages ST1, ST3, ST5, . . . , STn−1 receives a corresponding one of the first clock signal CLK1 and the third clock signal CLK3 as a clock signal.

Each of the second group driving stages ST2, ST4, ST6, STn has a dependent connection relationship in which a scan signal outputted from the previous second group driving stage is received as a carry signal. In an embodiment, the second group driving stage ST4 receives the scan signal GI2 outputted from the previous second group driving stage ST2 as a carry signal, and the second group driving stage ST6 receives the scan signal GI4 outputted from the previous second group driving stage ST4 as a carry signal, for example.

Each of the second group driving stages ST2, ST4, ST6, STn receives a corresponding one of the second clock signal CLK2 and the fourth clock signal CLK4 as a clock signal.

Figure 14:
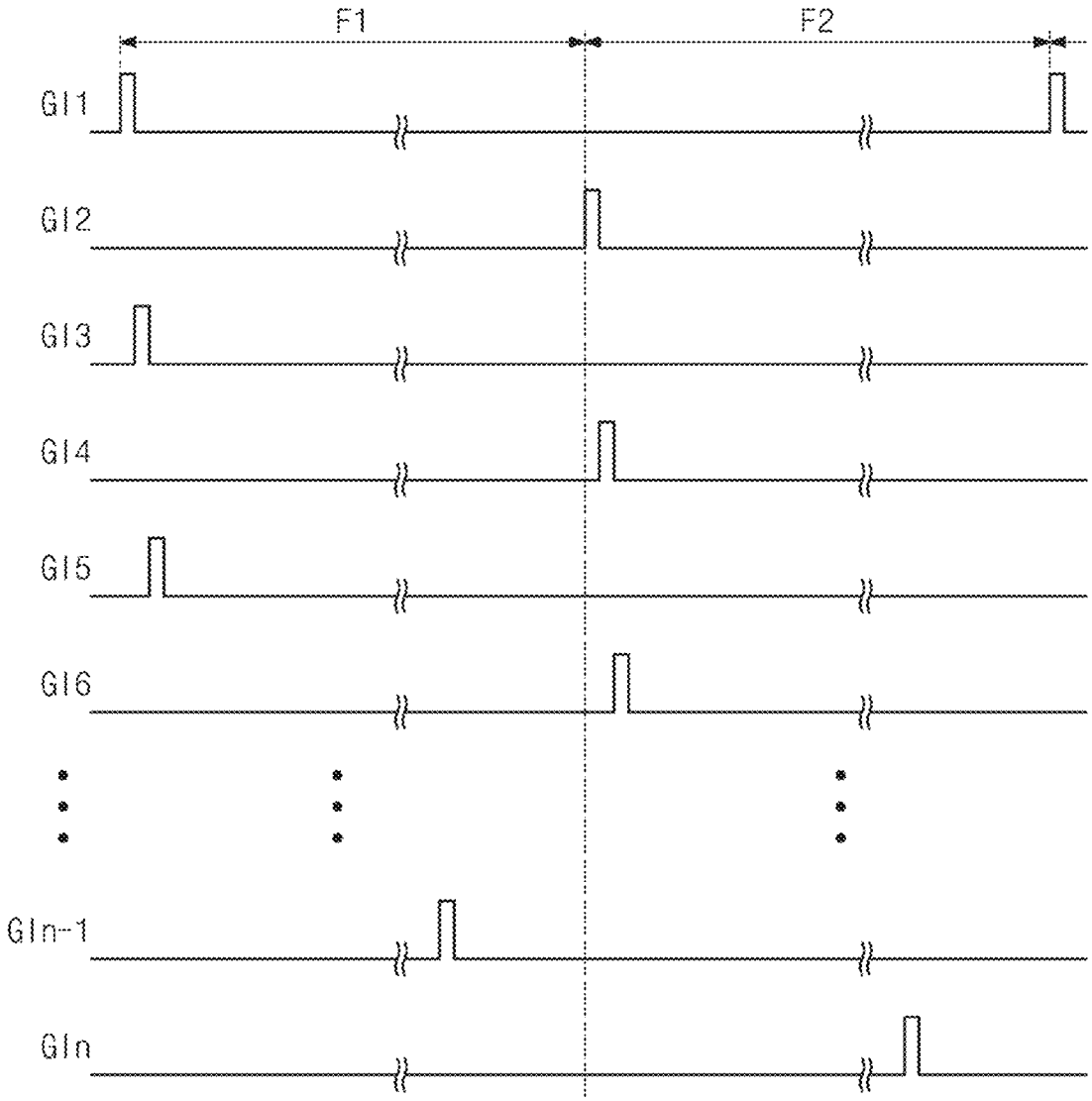
FIG. 14 is a timing diagram illustrating an operation of the scan driving circuit shown in FIG. 13.

FIG. 14 is a timing diagram illustrating an operation of the scan driving circuit shown in FIG. 13.

Referring to FIGS. 13 and 14, during the first frame F1, the first group driving stages ST1, ST3, ST5, . . . , STn−1 sequentially output odd-numbered scan signals GI1, GI3, GI5, . . . , GIn−1 at a high level.

During the second frame F2, the second group driving stages ST2, ST4, ST6, STn sequentially output even-numbered scan signals GI2, GI4, GI6, GIn at a high level.

As described above, in the odd-numbered frame, only the first group driving stages ST1, ST3, ST5, . . . , STn−1 among the driving stages ST1 to STn operate, and in the odd-numbered frame, only the second group driving stages ST2, ST4, ST6, STn among the driving stages ST1 to STn operate so that the power consumption of the display device may be reduced.

However, since only some of the driving stages ST1 to STn operate in every frame, and other parts are maintained in a non-operating state. As described with reference to FIG. 8B, the gamma level and/or luminance of an image displayed on the display device may be lowered.

The display device DD (refer to FIG. 1) to which the compensation scheme described with reference to FIGS. 9 to 12 is applied may predict a decrease in gamma level and/or luminance of an image in advance, and provide the compensated image data signal DATA to the data driving circuit 200. Accordingly, it is possible to prevent the display quality from deteriorating while reducing the power consumption of the display device DD.

In the embodiment shown in FIG. 7, during multi-frequency mode, among the scan signals GI1921-GI3840 corresponding to the second display area DA2 (refer to FIG. 1), odd-numbered scan signals GI1921, GI1923, GI3839 and even-numbered scan signals GI1922, GI1924, GI3840 may be alternately driven every frame.

When the first driving frequency of the first display area DA1 and the second driving frequency of the second display area DA2 are different from each other, as described with reference to FIGS. 8A and 8B, the optical waveforms of the first display area DA1 and the second display area DA2 may vary.

The display device DD (refer to FIG. 1) to which the compensation scheme described in FIGS. 9 to 12 is applied may predict a decrease in gamma level and/or luminance of an image to be displayed in the second display area DA2 in advance, and provide the compensated image data signal DATA to the data driving circuit 200. Accordingly, it is possible to prevent the display quality from deteriorating while reducing the power consumption of the display device DD.

When a moving image is displayed in the first display area and a still image is displayed in the second display area, the display device having such a configuration may operate in a multi-frequency mode in which the first display area is driven at the first driving frequency and the second display area is driven at the second driving frequency. In the multi-frequency mode, by compensating for the luminance and/or gamma of an image displayed in the second display area, it is possible to prevent the display quality from deteriorating.

Although the embodiments of the invention have been described, it is understood that the invention should not be limited to these embodiments but various changes and modifications may be made by one ordinary skilled in the art within the spirit and scope of the invention as hereinafter claimed.

What is claimed is:

1. A display device comprising:

a display panel comprising a first display area and a second display area, each of the first display area and the second display area including a plurality of pixels, and a pixel of the plurality of pixels being connected to a corresponding data line of a plurality of data lines and corresponding scan lines of a plurality of scan lines;

a data driving circuit which drives the plurality of data lines;

a scan driving circuit which drives the plurality of scan lines; and a driving controller which controls the data driving circuit and the scan driving circuit such that, the first display area is driven at a first driving frequency, and the second display area is driven at a second driving frequency lower than the first driving frequency during a multi-frequency mode, wherein the driving controller receives an image signal and provides to the data driving circuit an image data signal obtained by compensating for a gamma level of the image signal corresponding to the second display area during the multi-frequency mode.

2. The display device of claim 1, wherein the driving controller comprises:

a frequency mode determination part which determines an operation mode based on the image signal and a control signal and output a mode signal; and a signal generation part which receives the image signal and the control signal and outputs the image data signal, a data control signal, and a scan control signal corresponding to the mode signal, wherein the data control signal is provided to the data driving circuit, wherein the scan control signal is provided to the scan driving circuit.

3. The display device of claim 2, wherein the signal generation part comprises:

a lookup table which stores a compensation value; and a compensator which outputs the image data signal obtained by compensating the image signal with the compensation value based on the mode signal and the image signal.

4. The display device of claim 3, wherein the mode signal comprises information on the first driving frequency of the first display area and the second driving frequency of the second display area.

5. The display device of claim 4, wherein the compensator receives a compensation value corresponding to a difference value between the first driving frequency of the first display area and the second driving frequency of the second display area from the lookup table in response to the mode signal.

6. The display device of claim 3, wherein the compensator receives a compensation value corresponding to the image signal from the lookup table.

7. The display device of claim 3, wherein the compensator outputs the image data signal by adding the compensation value from the lookup table and the image signal.

8. The display device of claim 2, wherein the driving controller controls the data driving circuit and the scan driving circuit such that the first display area and the second display area are each driven at a normal frequency while the operation mode is a normal mode.

9. The display device of claim 8, wherein the first driving frequency is higher than or equal to the normal frequency, wherein the second driving frequency is lower than the normal frequency.

10. A display device comprising:

a display panel comprising a first display area and a second display area, each of the first display area and the second display area including a plurality of pixels, and a pixel of the plurality of pixels being connected to a corresponding data line of a plurality of data lines and corresponding scan lines of a plurality of scan lines;

a data driving circuit which drives the plurality of data lines;

a scan driving circuit which drives the plurality of scan lines; and a driving controller which controls the data driving circuit and the scan driving circuit such that the first display area is driven at a first driving frequency, and the second display area is driven at a second driving frequency lower than the first driving frequency during a multi-frequency mode, wherein the driving controller receives an image signal and provides to the data driving circuit an image data signal obtained by compensating for the image signal to the data driving circuit as a compensation value corresponding to a difference value between the first driving frequency of the first display area and the second driving frequency of the second display area during the multi-frequency mode.

11. The display device of claim 10, wherein the driving controller comprises:

a frequency mode determination part which determines an operation mode based on the image signal and a control signal and outputs a mode signal; and a signal generation part which receives the image signal and the control signal, and outputs the image data signal, a data control signal, and a scan control signal corresponding to a difference value between the first driving frequency of the first display area and the second driving frequency of the second display area in response to the mode signal, wherein the data control signal is provided to the data driving circuit, wherein the scan control signal is provided to the scan driving circuit.

12. The display device of claim 11, wherein the signal generation part comprises:

a lookup table which stores a compensation value; and a compensator which outputs the image data signal obtained by compensating the image signal with the compensation value based on the mode signal and the image signal.

13. The display device of claim 11, wherein the driving controller controls the data driving circuit and the scan driving circuit such that the first display area and the second display area are each driven at a normal frequency while the operation mode is a normal mode.

14. The display device of claim 13, wherein the first driving frequency is higher than or equal to the normal frequency, wherein the second driving frequency is lower than the normal frequency.

15. A driving method of a display device, the method comprising:

dividing a display panel into a first display area and a second display area during a multi-frequency mode, driving the first display area at a first driving frequency, and driving the second display area at a second driving frequency;

calculating a difference value between the first driving frequency of the first display area and the second driving frequency of the second display area; and if the difference value is greater than or equal to a reference value, outputting an image data signal obtained by compensating for an image signal of the second display area.

16. The method of claim 15, wherein the outputting the image data signal obtained by compensating for the image signal of the second display area comprises:

outputting the image data signal by adding the image signal and a compensation value corresponding to a difference value between the first driving frequency of the first display area and the second driving frequency of the second display area.

17. The method of claim 15, wherein the outputting the image data signal obtained by compensating for the image signal of the second display area comprises:

outputting the image data signal by adding a compensation value corresponding to the image signal and the image signal.

18. The method of claim 15, further comprising outputting the image signal of the second display area as the image data signal when the difference value is less than the reference value.

19. The method of claim 15, further comprising driving the first display area and the second display area at a normal frequency during a normal mode.

20. The method of claim 19, wherein the first driving frequency is higher than or equal to the normal frequency, wherein the second driving frequency is lower than the normal frequency.

* * * * *